United States Patent [19]

Simonds et al.

[11] 4,368,718

[45] Jan. 18, 1983

[54] COMPOUND BOW WITH TWO-TRACK LEVER CAMS

[75] Inventors: Gary Simonds, Gainesville, Fla.; Arnold D. McKee, Hartford, Ill.

[73] Assignee: Victor United, Inc., Chicago, Ill.

[21] Appl. No.: 275,627

[22] Filed: Jun. 22, 1981

[51] Int. Cl.[3] ..... F41B 5/00

[52] U.S. Cl. ..... 124/23 R; 124/86; 124/DIG. 1

[58] Field of Search ..... 124/24 R, 23 R, 90, 124/DIG. 1

[56] References Cited

U.S. PATENT DOCUMENTS

| | | | |
|---|---|---|---|
| 3,486,495 | 12/1969 | Allen | 124/24 R |
| 3,744,473 | 7/1973 | Nishioka | 124/24 |
| 3,851,638 | 12/1974 | Alexander | 124/90 X |
| 3,958,551 | 5/1976 | Ketchum | 124/24 R |
| 4,060,066 | 11/1977 | Kudlacek | 124/23 R |
| 4,112,909 | 9/1978 | Caldwell | 124/DIG. 1 |
| 4,201,177 | 5/1980 | Holman et al. | 124/23 |
| 4,261,320 | 4/1981 | Barna | 124/24 R |
| 4,287,867 | 9/1981 | Islas | 124/24 R |
| 4,294,221 | 10/1981 | Bryant | 124/23 R |
| 4,300,521 | 11/1981 | Schmitt | 124/23 R |

*Primary Examiner*—Richard C. Pinkham
*Assistant Examiner*—William R. Browne
*Attorney, Agent, or Firm*—Emory L. Groff, Jr.

[57] ABSTRACT

A compound bow includes improved cam members eccentrically mounted upon the bow limb tips and including a bowstring segment adjacent a tension cable segment. The bowstring segment is provided with a main body section having a curved lever section extending outwardly therefrom. A groove or track is formed in the periphery of the curved lever section while a parallel groove or track is provided in the outer periphery of the tension cable segment. A bowstring end is disposed within each lever section track while each tension cable segment track receives the cam end of a tension cable. Adjustable or replaceable elements allow for the ready synchronization of the two cam members as well as variation of the bow draw weight. The two cam segments may be constructed either as a unitary member or as separate, angularly adjustable components.

16 Claims, 7 Drawing Figures

COMPOUND BOW WITH TWO-TRACK LEVER CAMS

This invention relates generally to compound bows and more particularly, to an improved eccentrically mounted cam member for mounting at the two limb tips of a compound bow.

Compound bows have become extremely popular among archers during the past 10 years. The broad concept of these bows involves the use of eccentrically mounted members such as pulleys, wheels or cams on the limb tips and about which the bowstring is sheaved such that when the bow is drawn, the draw force will initially rapidly build up to its maximum intended limit and thereafter noticeably fall off as the bow is fully drawn. The purpose and advantage of such an operation is well known to those skilled in the art and need not be repeated herein.

The majority of compound bows employ a bowstring working in combination with a pair of crossing tension cables, with or without the addition of other pairs of intermediate pulleys or cams. In many instances, the tension cables comprise two lengths of cable each having one of its ends joined to one of the two ends of the bowstring and thereafter passing around an adjacent pulley after which it crosses down or up to a point adjacent the opposite limb tip where it is anchored. An example of this type of compound bow will be found in the patent to Jennings, U.S. Pat. No. 4,241,715 dated Dec. 30, 1980. With such an arrangement, there are really only two free ends of the combined bowstring and tension cable assembly and since the pulley members each have two differently configured grooves or tracks for regulating the take-up and let-out of the respective cables and bowstring ends, it will be understood that means must be provided to transfer or crossover each tension cable between the two adjacent grooves of each pulley, such as depicted in the referenced U.S. Pat. No. 4,241,715.

A shortcoming of many existing compound bows as generally described above is that there is a restriction precluding independent adjustment of the bowstring and the two tension cables since the bowstring and two tension cables are combined to form a single, continuous cable assembly having two distal portions usually permanently anchored adjacent the two bow limbs.

By the present invention, an improved cam member is offered including a bowstring segment disposed adjacent a tension cable segment with each segment provided with a peripheral groove or track respectively adapted to receive and control the take-up and let-out of both a separate bowstring as well as the terminal end of one of two individual tension cables. The bowstring segment includes a track defining a radius of curvature substantially distinct from that of the tension cable track and radially projecting well away from the tension cable segment. The two cam members on any one bow are mounted with the bowstring tracks aligned with the bow center-line while the respective tension cable tracks of the two cam members are disposed on opposite sides of the two bowstring segments. With the anchor portion of the two tension cables secured to the bow limbs adjacent the opposite or outer face of the bowstring segments it will be understood that a balanced force effect will be applied to the bow limbs relative the centerline.

Users of compound bows will readily appreciate the foregoing advantages since many well known types of pulley members impart a twisting motion to the bow limb tips, in view of the off-center disposition of both the bowstring and the tension cables with respect to the tips of the bow limbs.

The instant cam members each include the adjacent bowstring and tension cable segments which are combined as a unitary member and eccentrically mounted adjacent a bow limb tip. The bowstring segment is provided with a main body section disposed adjacent the tension cable segment and from which a hook or lever section extends. A curved track in the outer periphery of the lever section receives one end of the bowstring while one end of a tension cable is sheaved within the tension cable track. The distal portions of both the bowstring and tension cable are adjustably anchored within their respective cam member segments. With the foregoing construction, a desired draw curve for any compound bow may be readily determined by the peripheral configuration of the bowstring segment lever section as well as the tension cable segment and synchronization or tuning of the two cam members in any one compound bow as well as alteration of its draw weight, may be readily accomplished in view of releasable means associated with the adjustable anchoring of the terminal portions of both the bowstring and tension cables.

Accordingly, one of the objects of the present invention is to provide an improved compound bow having a pair of eccentrically mounted cam members, each including a pair of segments provided with peripheral tracks of significantly different configurations respectively receiving one end of a tension cable and one end of a bowstring.

Another object of the present invention is to provide an improved compound bow employing two-track lever cams with each track respectively receiving one distal portion of a bowstring and tension cable and having releasable anchor means for adjustably securing both the bowstring and tension cables in their respective tracks.

A further object of the present invention is to provide an improved compound bow having cam members including a substantially round tension cable segment disposed adjacent a bowstring segment provided with an outwardly projecting lever section with the two segments having curved peripheral tracks independently receiving the end portions of a separate bowstring and tension cable.

Still another object of the present invention is to provide an improved compound bow having two-track lever cams each having a separate tension cable and bowstring segment and having means for adjustably joining the two segments together as a unitary member in various angular relationships.

Another object of the present invention is to provide an improved compound bow including a pair of two-track lever cams provided with removable and replaceable bushing elements insertable in the cam for altering the degree of eccentric mounting thereof adjacent the bow limb tips.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawing.

Figure 1:
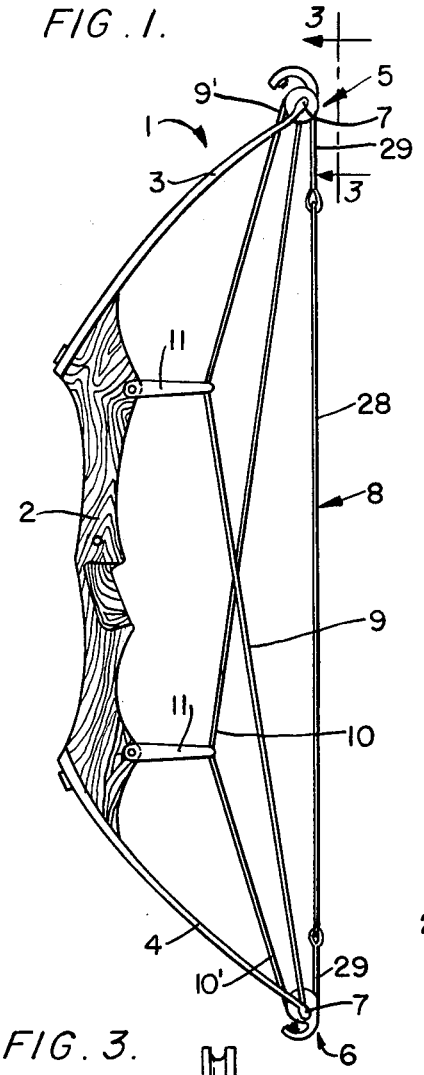
FIG. 1 is a side elevation of a compound bow according to the present invention.
Figure 3:
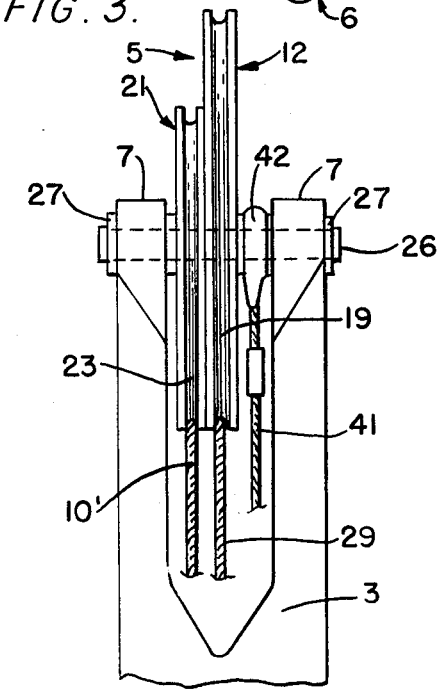
FIG. 3 is a rear elevation taken along the line 3—3 of FIG. 1.

Referring now to the drawing, particularly FIG. 1, the present invention will be understood to relate to a compound bow, generally designated 1, including a central handle 2 having an upper limb 3 and lower limb 4 suitably attached thereto. Inasmuch as the essence of the present invention concerns the construction of the cam members 5 and 6 mounted adjacent the two bow limb tips 7 and the relationship of these cams to the bowstring 8 and the two tension cables 9 and 10, it will be appreciated that the specific construction or configuration of the bow handle 2 and its limbs 3–4 may obviously differ from that as illustrated in the drawing. Likewise, although the cams 5 and 6 are illustrated in FIGS. 1 and 3 as being mounted for arcuate displacement between the split ends of the bow limb tips 7, it will be understood that other well known means for mounting the cams may be employed, such as brackets as depicted in the previously referred to U.S. Pat. No. 4,241,715. Additionally, inclusion of tension cable guides 11 to maintain the crossing point of the cables 9 and 10 clear of the bowstring nocking point and/or the arrow axis, is entirely optional.

Figure 2:
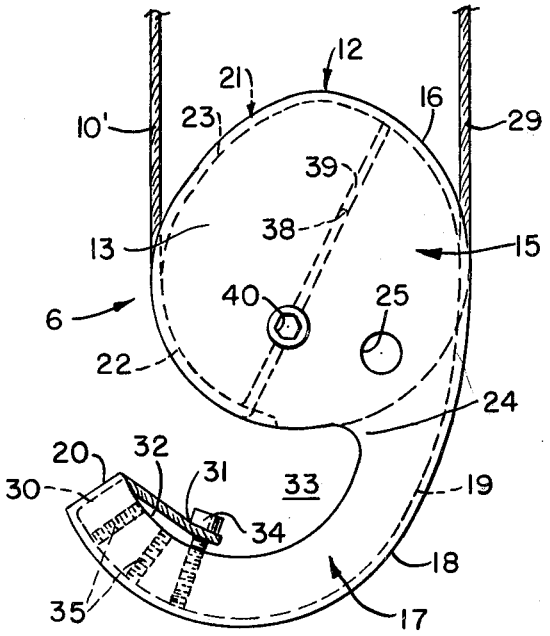
FIG. 2 is an enlarged side elevation of the bottommost cam of FIG. 1.

FIG. 2 of the drawing, most clearly illustrates the specific construction of the cam 6 as mounted adjacent the tip of the lower bow limb 4. Actually, the cam 6 is identical to the cam 5 located upon the upper limb 3 and is merely turned over 180° before attachment thereto. Thus, each cam 5 or 6 will be seen to comprise a unitary member including a planar bowstring segment 12 having an outer face 13 and inner face 14. This bowstring segment 12 is provided with a main body section 15 of substantially rounded configuration as defined by its outer curved periphery 16 and which is joined, in an integral manner, to an outwardly projecting hook or lever section 17 provided with an outer curved periphery 18 which will be seen to be substantially tangent to a portion of the curved periphery 16 of the main body section 15. A groove or track 19 is disposed in the curved periphery 18 of the bowstring segment and extends from the tip 20 thereof throughout the extent of the lever periphery 18 and continues into at least a portion of the curved periphery 16 of the main body section 15.

Extending from the inner face 14 of the bowstring segment 12 is a tension cable segment, generally designated 21. This latter segment likewise may be provided with a substantially rounded configuration such that its outer curved periphery 22 is congruent with the curved periphery 16 of the bowstring segment main body section 15. In any case, it will be understood that the periphery 22 of the tension cable segment 21 is also provided with a groove or track 23 extending at least throughout a substantial portion of its extent from a point beginning adjacent to the juncture 24 between the lever section 17 and main body section 15 of the bowstring segment 12.

Disposed through each main body section 15 of the bowstring segments as well as the adjacent tension cable segments 21 are pivot support means comprising a transverse pivot shaft bore 25 which will be seen to be eccentrically located with respect to the peripheries of the two components of the cams and which is adapted to be journaled about a pivot shaft 26 suitably supported adjacent each bow limb tip 7. Appropriate retainer elements 27 secure the pivot shafts in this position.

With the two cams 5 and 6 mounted as shown in FIG. 1 of the drawing, the relationship of the previously mentioned tracks 19 and 23 to the associated bowstring or tension cables may now be described. The bowstring 8 may comprise a single length of cable or alternatively, as shown in FIG. 1, may include a replaceable medial segment 28 releasably joined to a pair of bowstring end portions 29—29. With such an arrangement, that portion of the bowstring which first shows signs of wear, namely the nocking point, may be readily replaced in the field without requiring replacement of the end portions 29 directly associated with the cams. Whether or not the bowstring assembly comprises a plurality of components or a single string length, it will be considered a unitary assembly having the two end portions 29—29.

The bowstring will be seen to span the two cams 5–6 with each of its end portions 29 sheaved within a respective track 19 of the bowstring segment 12. In the arrangement of FIG. 2, the bowstring end portion 29 will be seen to pass within a groove 30 formed in the lever tip 20 such that the end 31 of the bowstring end portion 29 is juxtaposed the inner periphery 32 of the hook section 17 at a point within the space or clearance 33 separating the bowstring segment hook section 17 from the main body section 15. Removable anchor means such as the screw 34 engages the bowstring end 31 and is selectively insertable within any one of a plurality of tapped bores 35 extending into the lever section 17 from its inner periphery 32. With the plurality of bores 35 thus variably spaced from the lever section tip 20, it will follow that adjustable means are provided for achieving variation of the tension being applied to the bowstring 8 when attached to the two spaced apart cams 5 and 6.

Figure 4:
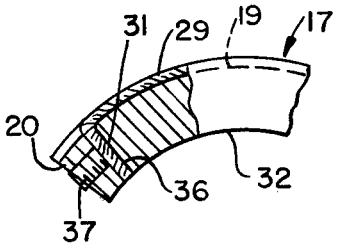
FIG. 4 is a fragmentary side elevation, partly in section, illustrating an alternate bowstring anchor means.

FIG. 4 of the drawing, illustrates a modification for providing adjustable anchoring means for the bowstring end 31 which in this instance, will be seen to be slidably disposed within a bore 36 which need not be tapped and which extends from the juxtaposed curved track 19 all the way through to the inner periphery 32 of the lever section 17. When the bowstring end 31 is properly positioned according to the archer's desire, an appropriate removable anchor means such as the screw 37 extending through the lever tip 20, is tightened to engage the bowstring end 31.

Each of the two individual tension cables 9 and 10 includes at one end a cam portion 9′ and 10′ respectively sheaved about the track 23 formed in the periphery of the tension cable segment 21 of the two cams 5 and 6. The ends 38 of the respective tension cable cam portions are disposed within a bore 39 formed within the body of the tension cable segment 21 having one end communicating with the tension cable track 23 as shown most clearly in the enlarged view of FIG. 2 of the drawing. When the tension cable 9 or 10 is properly adjusted, anchor means in the form of an appropriate removable fastener, such as the set screw 40, is tightened to engage its inner-most tip with that portion of the tension cable disposed within the bore 39.

The opposite end or anchor portion 41 of each of the two tension cables 9 and 10 are appropriately attached adjacent the two opposite limbs and this attachment may comprise any suitable arrangement which preferably allows for pivotal movement of the anchor portion 41 during use of the bow. FIG. 3 of the drawing, illustrates an appropriate means for providing this pivotal attachment wherein the attachment means comprises a bushing 42 journaled about the pivot shaft 26 and to which the anchor portion 41 of the tension cable is secured.

Considering both FIGS. 1 and 3, it will be seen that with the mounting of the two cams 5 and 6 as shown, the tension cable segment 21 of one cam 5 will be disposed to the left of the centrally disposed bowstring segment 12 while the tension segment 21 of the lower cam 6 will be disposed to the right of the centrally disposed bowstring segment 12. Therefore, with the understanding that the track 19 of the bowstring segment 12 is aligned with the center-line of the bow, it will be appreciated that the associated tension cable cam portion and anchor portion 41 will be equally spaced to either side of the inner face 14 and outer face 13 respectively, of the bowstring segments such that an equalization of forces will be applied to the two bow limb tips 7—7 during draw and release of the bow 1.

The curvature of both the tension cable track 23 as well as the configuration of the bowstring segment lever section 17 and its track 19 may obviously be modified to produce either a more rounded or constant radius configuration or alternatively, to produce a more varied configuration so as to alter the draw curve or let-off point of the draw force. An obvious distinction between the radii employed to form the two tracks 19 and 23 is that the bowstring segment track 19 includes a substantial portion defined by a radius which is noticeable greater than the radius employed in defining the tension cable track 23.

Figure 5:
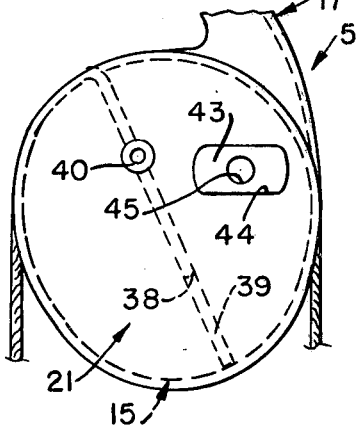
FIG. 5 is a fragmentary side elevation of an alternate cam construction.
Figure 6:
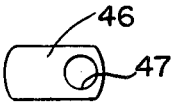
FIG. 6 is a side elevation of a replacement bushing for use in the cam illustrated in FIG. 5.

As is well known to those familiar with this art, the geometry of the draw curve is affected by the location of the pivot shaft bore 25. Usually the axis of this bore is fixed and thus results in a permanently fixed point of eccentricity yet there may be an occasion when an archer would like to achieve a significantly different bow action by varying this pivot axis and accordingly, a modification is shown in FIGS. 5 and 6 of the drawing, wherein this pivot axis is defined by a replaceable bushing 43 press-fitted within a mating inset or recess 44. In the example of FIG. 5, the bushing 43 is provided with a centrally disposed bore 45 and when it is desired to vary the point of eccentricity, this bushing is removed and the alternate bushing 46 shown in FIG. 6 is installed. The pivot shaft bore 47 of this bushing 46 will be seen to be located to one end of the bushing and in this manner, by utilizing the two bushings 43 and 46, it will be appreciated that a selection of three different locations for the pivot bore may be achieved merely by reversing the bushing 46 180° in order to relocate its bore 47 at the other end thereof.

Figure 7:
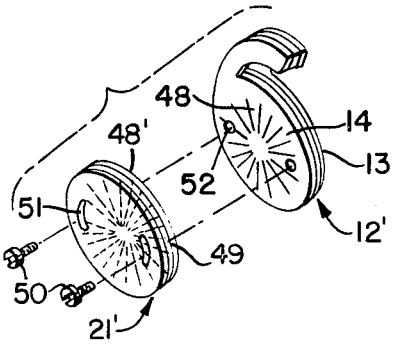
FIG. 7 is an exploded perspective view of an alternate cam construction.

As previously mentioned, the cam members 5 and 6 comprise a unitary member and although the embodiments described hereinabove relate to a cam wherein the bowstring segment and tension cable segment are integral, it will be appreciated that these two segments may comprise two separate relatively adjustable cam elements. FIG. 7 of the drawing discloses a bowstring segment 12′ and a separate tension cable segment 21′ wherein each of these two segments are constructed substantially identical to the earlier described segments 12 and 21 but are provided with mating means enabling adjustable attachment of the two segments in order to vary the relative angular disposition of the irregularly configured periphery of the tension cable segment 21′ with respect to the disposition of the bowstring segment track 19. In this embodiment, the inner face 14 of the main body section of the bowstring segment 12′ may be provided with connection means 48 adapted to cooperate with mating connection means 48′ on the inner face 49 of the separate tension cable segment 21′. These connection means may comprise any suitable elements such as radial deformations comprising serrations, ribs or grooves adapted to assist in maintaining the angular alignment between the two segments when assembled in a juxtaposed manner and secured together by means of fasteners 50 disposed through elongated arcuate openings 51 in the tension cable segment and cooperating with tapped bores 52 in the bowstring segment. The inclusion of the connecting means 48—48′ is not mandatory since the fasteners 50 and the cooperating arcuate openings 51 can suffice to maintain the appropriate angular relationship between the two assembled segments.

To provide for the eccentric mounting of the cam of FIG. 6, a pivot shaft bore (not shown) would be formed in the segment 12′ while an enlarged, arcuate opening through the adjacent segment 21′ would provide interference-free accommodation of the shaft 26 throughout a limited but effective range of relative angular displacement between the two segments.

We claim:

1. In a compound bow including a handle, upper and lower limbs extending from said handle and each having a tip, pivot support means mounted adjacent each said limb tip, a cam member eccentrically mounted for pivotal displacement upon each said pivot support means, a bowstring spanning and engaging said two cam members, a pair of tension cables, each said tension cable having a cam portion engaging one said cam member and an anchor portion secured relative an opposite said cam member, the improvement comprising; said cam members each including a bowstring segment and an adjacent tension cable segment, said cam member having an eccentrically disposed bore, said pivot support means disposed through said cam member bore, said tension cable segment provided with an outer curved periphery having a track, said bowstring segment including an arcuately extending hook section provided with an outer periphery having a track, said bowstring having opposite free end portions respectively disposed in said hook section tracks of said two cam members, and said tension cable cam portions respectively disposed in said tension cable segment tracks of said two cam members.

2. A compound bow according to claim 1 wherein, said bowstring segment includes a main body section joined to said hook section and said bore extends through said tension cable segment and said main body section.

3. A compound bow according to claim 2 wherein, said hook section is radially spaced from said main body section to define a substantial clearance therebetween.

4. A compound bow according to claim 1 wherein, each said bowstring segment main body section and hook section comprise an integral member.

5. A compound bow according to claim 1 wherein, said hook section outer periphery and track are curved.

6. A compound bow according to claim 1 wherein, each said bowstring end portion terminates in a distal portion, each said hook section having a tip, and releasable anchor means adjacent said hook section tip operable to adjustably secure said bowstring distal portion to said cam member.

7. A compound bow according to claim 1 wherein, said tension cable cam portions terminate in a cable end, said tension cable segments each having an internal bore communicating with said tension cable segment track, said cable end adjustably insertable within said internal bore, and releasable anchor means carried by said tension cable segment operable to engage and secure said cable end within said internal bore.

8. A compound bow according to claim 1 wherein, the majority of said tension cable segment track comprises a substantially constant radius.

9. A compound bow according to claim 1 wherein, the radius of said tension cable segment track varies to provide an irregularly configured main body section track.

10. A compound bow according to claim 1 including, replaceable bushing means insertable in said cam member bore to vary the eccentricity of said bore.

11. A compound bow according to claim 1 wherein, said two cam members are of identical configuration with said hook sections disposed away from said bow handle, said bowstring segment tracks disposed in a common plane aligned with the center-line of the bow and one said tension cable segment positioned on one side of the bow center-line and the other said tension cable segment positioned on the other side of the bow center-line.

12. A compound bow according to claim 11 wherein, said tension cable anchor portions secured to said pivot support means adjacent said bowstring segments.

13. A compound bow according to claim 1 wherein, the combination of said hook section and tension cable segment tracks substantially defines a spiral configuration in side elevation.

14. A compound bow according to claim 1 wherein, said bowstring segment and tension cable segment of each cam member comprise an integral component.

15. A compound bow according to claim 1 wherein, said bowstring segment and tension cable segment of each cam member comprise separate components, and fastener means releasably securing said two segments in adjacent assembled relationship.

16. A compound bow according to claim 15 including, adjustment means engageable by said fastener means allowing relative angular displacement between said bowstring segment and tension cable segment.

* * * * *